US010145389B2

(12) United States Patent
G. R.

(10) Patent No.: US 10,145,389 B2
(45) Date of Patent: Dec. 4, 2018

(54) MULTI NOZZLE DEVICE FOR PRECISE PRESSURE CONTROL OF GASES AND FLUIDS

(71) Applicant: Bharath Sai Kumar G. R., Tumkur (IN)

(72) Inventor: Bharath Sai Kumar G. R., Tumkur (IN)

( * ) Notice: Subject to any disclaimer, the term of this patent is extended or adjusted under 35 U.S.C. 154(b) by 370 days.

(21) Appl. No.: 14/896,926

(22) PCT Filed: Jun. 12, 2014

(86) PCT No.: PCT/IN2014/000391
§ 371 (c)(1),
(2) Date: Dec. 9, 2015

(87) PCT Pub. No.: WO2014/203272
PCT Pub. Date: Dec. 24, 2014

(65) Prior Publication Data

US 2016/0131161 A1 May 12, 2016

(30) Foreign Application Priority Data

Jun. 19, 2013 (IN) ..... 2664/CHE/2013

(51) Int. Cl.

| | |
|---|---|
| ***F04F 5/16*** | (2006.01) |
| ***B06B 1/10*** | (2006.01) |
| ***B06B 1/18*** | (2006.01) |
| ***F04F 5/18*** | (2006.01) |
| ***F04F 5/46*** | (2006.01) |

(52) U.S. Cl.
CPC ..... *F04F 5/16* (2013.01); *B06B 1/10* (2013.01); *B06B 1/18* (2013.01); *F04F 5/18* (2013.01); *F04F 5/466* (2013.01)

(58) Field of Classification Search
CPC ..... Y10T 137/86734; Y10T 137/86799; B06B 1/10; B06B 1/18; F04F 5/16; F04F 5/18; F04F 5/466
USPC ..... 137/625.3, 625.38
See application file for complete search history.

(56) References Cited

U.S. PATENT DOCUMENTS 4,041,982 A * 8/1977 Lindner ..... F16K 47/08 137/625.3
6,505,646 B1 * 1/2003 Singleton ..... F16K 47/08 137/625.3

* cited by examiner

*Primary Examiner* — Eric Keasel

(57) ABSTRACT

According to an aspect of the present invention, multi nozzle device comprises hollow inner cylinder and an outer cylinder. The hollow inner cylinder may have multiple nozzles along the length of said inner cylinder. The hollow inner cylinder may be coupled to a first pressure. The outer cylinder may be mounted over said inner cylinder such that internal diameter of said outer cylinder is in push fit with external diameter of said inner cylinder. The push fit is chosen to minimize friction to enable the outer cylinder to take place of the flapper. The outer cylinder is moved exposing the nozzles and the first pressure is reduced by a proportion related to number of nozzles exposed. In one embodiment, multi nozzle device further comprise, an O ring to prevent leakage of pressure when the inner cylinder and the outer cylinder are tight fit. In another embodiment, pressure is pneumatic pressure which may be coupled to the hollow part of the inner cylinder such that pneumatic pressure is released through the nozzles when the outer cylinder is moved exposing the nozzles.

8 Claims, 11 Drawing Sheets

| Displacement – (mm) | Chamber Pressure – ($P_p kgf/cm^2$) |
|---|---|
| 0.0 | 2.475 |
| 0.1 | 2.39 |
| 0.2 | 1.75 |
| 0.3 | 1.0 |
| 0.4 | 0.3 |
| 0.5 | 0.25 |
| 0.6 | 0.21 |

| Displacement (mm) | Chamber Pressure – $(P_p kgf/cm^2)$ | | |
|---|---|---|---|
| | Ps = 3.5 | Ps = 3.0 | Ps = 2.5 |
| 0 | 3.150 | 2.700 | 1.900 |
| 1 | 2.550 | 2.000 | 1.300 |
| 2 | 2.400 | 1.850 | 1.000 |
| 3 | 2.170 | 1.650 | 0.900 |
| 4 | 2.000 | 1.500 | 0.850 |
| 5 | 1.875 | 1.350 | 0.800 |
| 6 | 1.750 | 1.250 | 0.750 |
| 7 | 1.625 | 1.100 | 0.650 |
| 8 | 1.425 | 1.000 | 0.625 |
| 9 | 1.375 | 0.950 | 0.575 |
| 10 | 1.200 | 0.800 | 0.550 |
| 11 | 1.100 | 0.725 | 0.495 |
| 12 | 0.950 | 0.650 | 0.350 |
| 13 | 0.650 | 0.500 | 0.300 |

FIG. 3B

MULTI NOZZLE DEVICE FOR PRECISE PRESSURE CONTROL OF GASES AND FLUIDS

CROSS REFERENCES TO RELATED APPLICATIONS

This application claims priority from Indian patent application No. 2664/CHE/2013 filed on Jun. 19, 2013 which is incorporated herein in its entirety by reference.

STATEMENT REGARDING FEDERALLY SPONSORED RESEARCH OR DEVELOPMENT

Not Applicable

COPYRIGHT NOTIFICATION

No Copyright Notification

BACKGROUND

Technical Field

The embodiments herein generally relate to the field of pressure/flow control of gases and fluids, more specifically, it relates to a multi nozzle device assembly, which enables precise control and regulation of gas and fluid pressure and/or flow.

Related Art

Pressure/flow of fluid/gas is often used to operate/move mechanical parts in a machine or mechanical systems. Generally, pressure/flow of liquid/gas is used to achieve a work done in a mechanical system. Various control devices that are operative to vary the pressure of the fluid/gas and are operative to control pressure or flow (change the flow direction for example) based on a feedback or excitation signal are employed. The pneumatic flapper valve control mechanism is one such device/method generally used in these applications. The flapper valve are used in various applications such as but not limited to: pressure control valve, pressure to electrical transducer (servo valve), membrane control system, Instrument Pressure (I/P), Axial piston pump control, Pressure compensated flow control valves, steam boilers, tracer lines, ironers, storage tanks, acid baths, storage calorifiers, unit heaters, heater batteries, OEM equipment, distribution mains, boiler houses, slow opening/warm-up systems with a ramp and dwell controller, pressure control of large autoclaves, pressure reduction supplying large steam distribution systems, desuperheaters, controlling pressure to control temperature, blow-through drying rolls in a paper mill, dairy cream pasteurizer etc.

FIG. 1A shows the conventional nozzle flapper valve to illustrate the basic principle of the nozzle flapper valve. The entity 100 depicts the conventional nozzle flapper valve to illustrate the basic principle of the nozzle flapper valve along with the drawbacks and limitation involved in the conventional flapper valve. Further the conventional nozzle flapper valve 100 comprises of flapper with a plate shape body with surface arranged to be at right angles with the axis of the nozzle 115.

In the flapper valve control, it is experienced that the effective range of the opening that controls the pressure is limited to less than a millimeter ($\Delta x$). Such limitation implies that the mechanical arrangement operating to move the flapper needs to be very precise and has within 1 mm as its dynamic adjustable range. Beyond this distance, the controlling effect cease. In some cases, the backlash of other connected mechanical parts may be of such magnitude, which could itself be more than the working range of the conventional flapper valve. Further, due to the angular orientation of the flapper and the orifice (nozzle of the flapper valve), there is bound to be air leakage leading to inaccurate sealing and poor pressure control.

FIG. 1B is an example of the conventional nozzle flapper valve operative in an example mechanical system. As shown, the nozzle flapper control device 101 comprises an exciter 190 as a primary vibrating source, which sets up or generates the vibrations with a corresponding amplitude and frequency on its output surface 195. The magnitude/amplitude and frequency of the exciter 190 imparting vibration on its output surface 195 may vary in time. A main cylinder 120 may be placed on the vibrating surface. As shown in the FIG. 1B, the transmission of the vibration from surface 195 to surface 135 is damped by the orifice 130 on surface 125. At the top of the cylinder 120 a flexible diaphragm 135 covers the main cylinder 120, on the center of which a payload 140 of mass M is placed. This payload 140 receives this transmitted vibration. A bell crank lever 180 senses the position of the payload 140. The bell crank lever 180 senses the vibration with the help of mechanical coupling 145 and translates the vibration to a flapper 150. The flapper 150 covers or uncovers a nozzle 155 depending on the position of payload 140.

Hence, covering the nozzle 155 connected to the cylinder 120 as shown. This nozzle 155 allows the leakage of the compressed air. The gap between the nozzle 155 and the flapper 150 is controlled by the movement of the flapper 150, thereby controlling the pressure in a way it counteracts the originally induced vibration in mutually opposite direction. Such controlling operation happens until an equilibrium status is reached and hence nullifies the originally induced vibration by the primary vibrating source exciter 190 by managing the pressure depending upon the distance of the flapper 150 from the nozzle 155. The compressed air (pneumatic) chamber 160 is the medium for the transfer of vibration from source exciter 190 to the payload 140. Such conventional nozzle flapper control device (described in FIG. 1) will have effective feedback limit of less than 1 mm working range of the flapper valve.

FIG. 1C is a table showing the working range of the conventional flapper valve.

FIG. 4 is another example of application of flapper valve. Shown there is a differential pneumatic vibration control arrangement for pneumatic control system. As shown here, it may have an electrically driven system to sense the source vibration like sensor mechanism driver 460 with a pair of coils or solenoids 420 and Ferro-magnetic plate 405. This may result movement of flapper control arm 410. In differential pneumatic vibration control arrangement shown here may have a pair of vibration feedback for left and right pneumatic systems. The right control system may have right nozzle 425, pneumatic input 435 and pneumatic output 450. The left control system may have left nozzle 430, pneumatic input 445 and pneumatic output 455. The vibration sensor 465 may be connected to the mechanical vibration to electrical signal converter with its final stage as sensor mechanism driver 460. This mechanical vibration to electrical signal converter and sensor mechanism driver 460 may drive individual solenoids to control the left 475 and right 470 flaps.

FIG. 7A is another example of differential pneumatic control arrangement using four way flapper nozzle. Here the actuator piston moves sideways in left or right motion in a chamber 745 with the help of the flow of the pressurized fluid passing through openings 735 and 740. 725 and 730 are constant orifices at both ends. 715 and 720 are two nozzles controlling the pressure on either side of the piston ring inside the chamber 745. The Flapper 710 controls the orifice areas of both the nozzles. Thus, the piston movement from left to right or vice versa is achieved by controlling the movement of the flapper 710. As mentioned, since the flapper's working range is limited, the fine control of the movement of the piston is not possible in this arrangement. Further, due to leakage between the flapper and nozzle, significant amount of energy is wasted.

Accordingly, a flow/pressure control valve is desirable that overcome above limitation while providing the operation of the flapper valve.

SUMMARY

According to an aspect of the present invention, multi nozzle device comprises hollow inner cylinder and an outer cylinder. The hollow inner cylinder may have multiple nozzles along the length of said inner cylinder. The hollow inner cylinder may be coupled to a first pressure. The outer cylinder may be mounted over said inner cylinder such that internal diameter of said outer cylinder is in push fit with external diameter of said inner cylinder to minimize friction. The outer cylinder is moved exposing the nozzles and the first pressure is reduced by a proportion related to number of nozzles exposed. In one embodiment, multi nozzle device further comprise, an O ring to prevent leakage of pressure when the inner cylinder and the outer cylinder are push fit. In another embodiment, pressure is pneumatic pressure which may be coupled to the hollow part of the inner cylinder such that pneumatic pressure is released through the nozzles when the outer cylinder is moved exposing the nozzles.

BRIEF DESCRIPTION OF DRAWINGS

FIG. 3B is an example list values illustrating the extended working range of the multi nozzle flapper valve.

DETAILED DESCRIPTION OF THE PREFERRED EXAMPLES

Figure 1A:
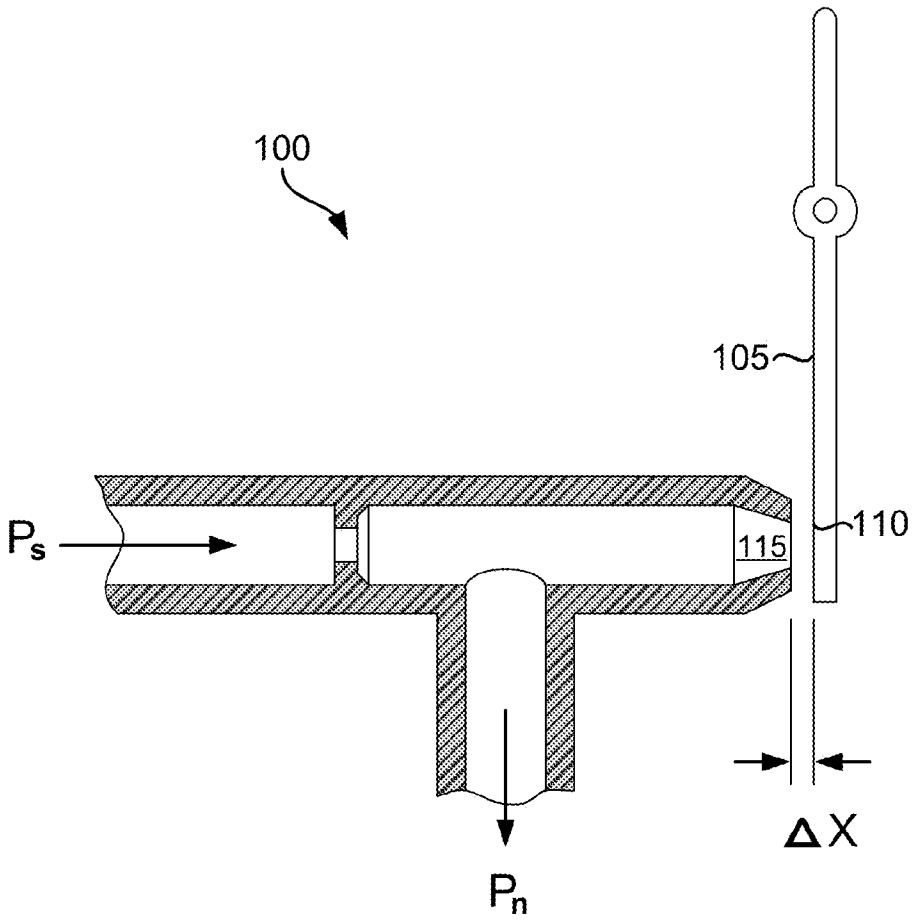
FIG. 1A shows the conventional nozzle flapper valve to illustrate the basic principle of the nozzle flapper valve.
Figures 1B, 1C:
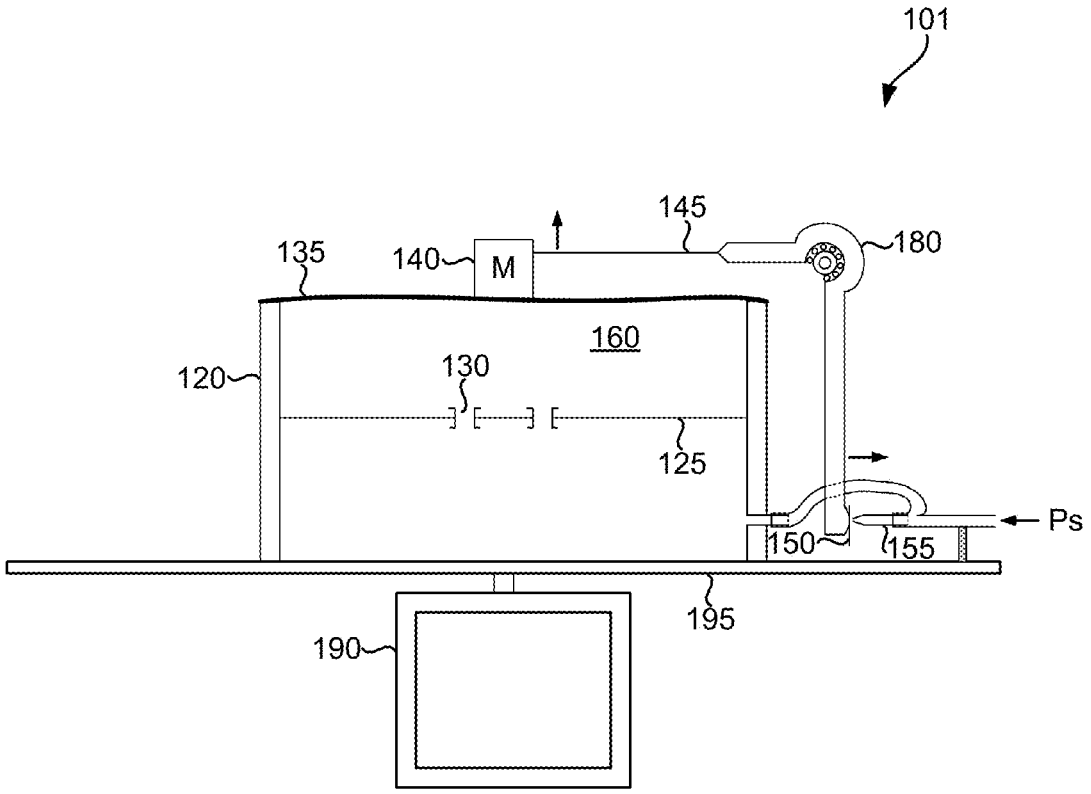
FIG. 1B is an example of the conventional nozzle flapper valve operative in an example mechanical system.
FIG. 1C is a table showing the working range of the conventional flapper valve.

Several embodiments are described below, with reference to diagrams for illustration. It should be understood that numerous specific details are set forth to provide a full understanding of the invention. One skilled in the relevant art, however, will readily recognize that embodiments may be practiced without one or more of the specific details, or with other methods, etc. In other instances, well-known structures or operations are not shown in detail to avoid obscuring the features of the invention.

As mentioned, there remains a need for developing device, which can be used to control and regulate the pressure variations or flow precisely. Referring now to drawings and more particularly to FIG. 2, FIG. 3, FIG. 5 and FIG. 6 where similar reference characters denote corresponding features consistently throughout the figures, there are shown preferred embodiments.

Figure 2A:
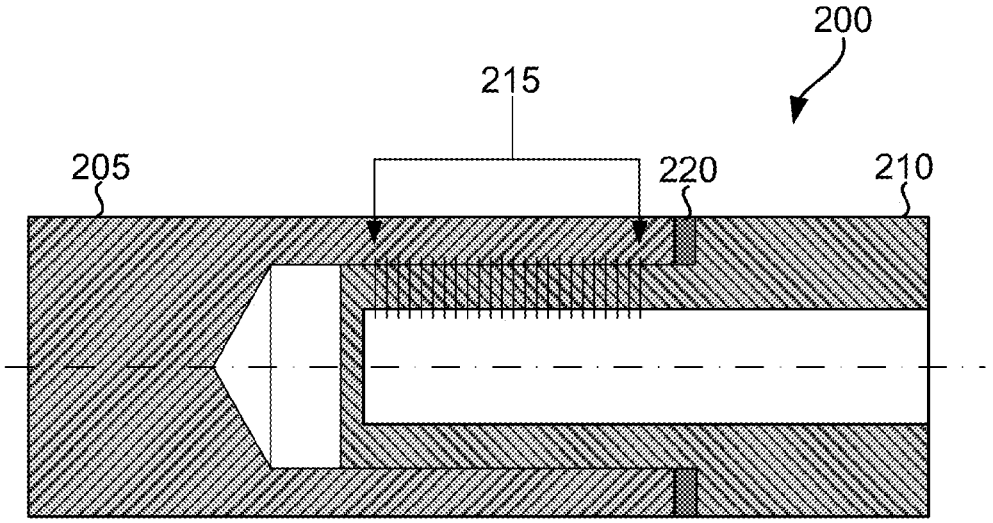
FIG. 2A illustrates a device for facilitating/controlling and regulating the fluid/gas pressure and/or flow in an embodiment.
Figure 2B:
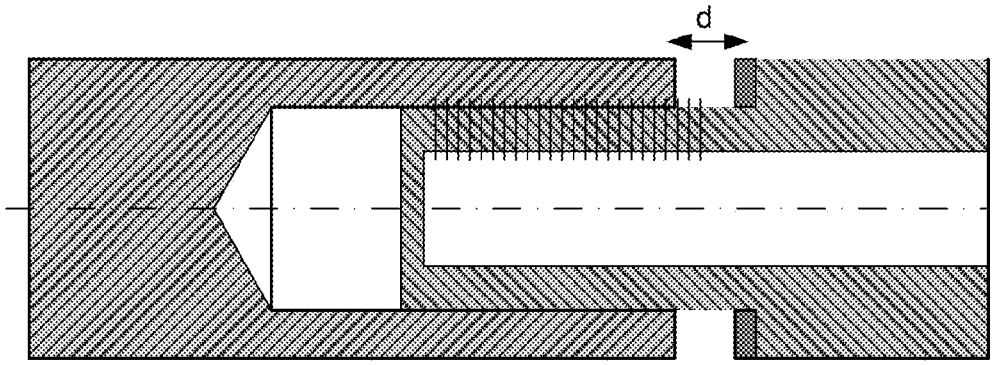
FIG. 2B through FIG. 2E, illustrates example movement of the outer cylinder relatively away from the inner cylinder exposing corresponding more number of nozzles.
Figure 2C:
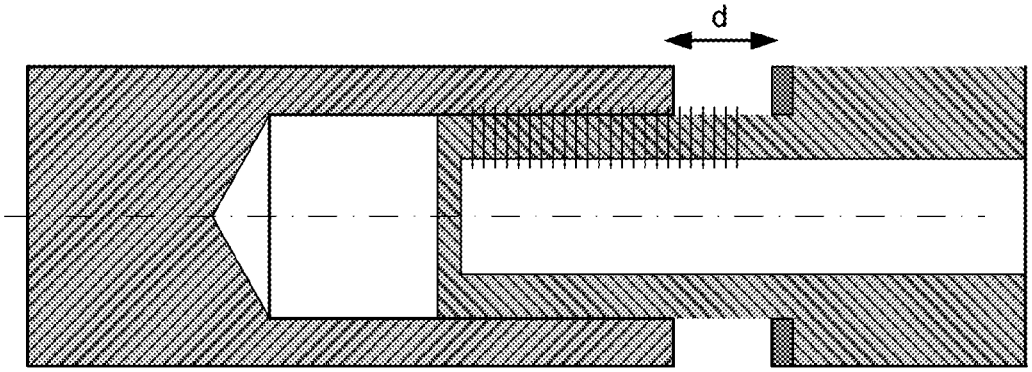
Figure 2D:
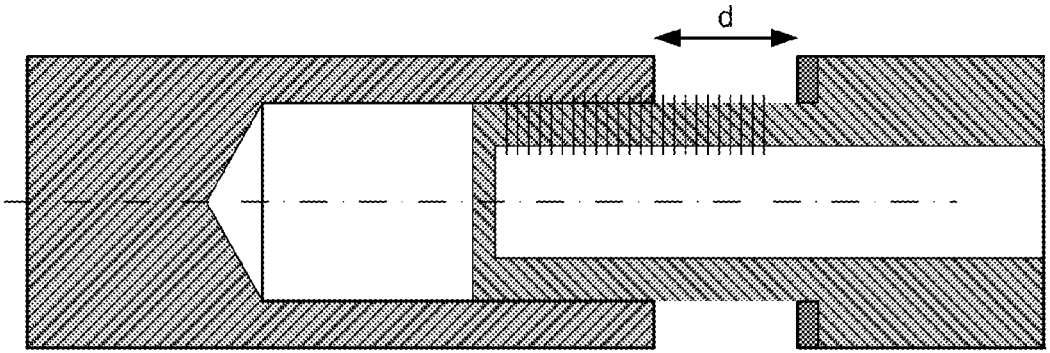
Figure 2E:
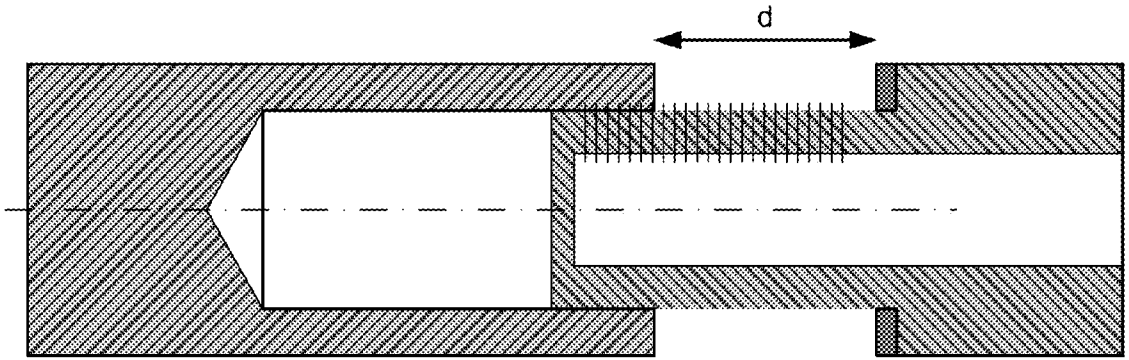

FIG. 2A illustrates a device for facilitating/controlling and regulating the fluid/gas pressure and/or flow in an embodiment. The device 200 comprises multiple nozzles arrangement. Accordingly, the multi nozzle device 200 is shown comprising reciprocating outer cylinder 205, stationary hollow inner cylinder 210, a plurality of holes 215 in the stationary hollow inner cylinder 210 and rubber 'O' ring 220. The internal diameter of the reciprocating outer cylinder 205 is in push fit with the external diameter of the stationary hollow inner cylinder 210 so that stationary hollow inner cylinder 210 can be inserted into the reciprocating outer cylinder 205. Moreover the stationary hollow inner cylinder 210 is hollow and takes the place of the nozzle and contains multiple holes 215 along its length. Similarly reciprocating outer cylinder 205 takes place of the flapper and capable of reciprocating or sliding over the stationary hollow inner cylinder 210. The push fit is selected to minimize the friction aspect so as to enable the outer cylinder to take the place of the flapper.

In an embodiment, when the reciprocating outer cylinder 205 moves or slides away from the stationary hollow inner cylinder 210 certain number of holes of the stationary hollow inner cylinder 210 are exposed which allow the fluid to escape and hence creating the certain pressure drop. When the outer reciprocating cylinder 205 moves further away from the stationary hollow inner cylinder 210, more holes are exposed and hence further decrease in the pressure drop occurs. The desired pressure can be regulated through the movement of the reciprocating outer cylinder 205 over the stationary hollow inner cylinder 210. Also, when the reciprocating outer cylinder 205 is at zero distance from the stationary hollow inner cylinder 210, pressure drop is zero and maximum pressure equal to supply pressure can be attained. At least one rubber 'O' rings 220 is mounted as shown to avoid any leakage of fluid when the reciprocating outer cylinder 205 is at zero position or zero displacement with the stationary hollow inner cylinder 210. According to an embodiment, the nozzle diameter and the distance between the multi nozzles can be varied according to the requirement and design required for a desired pressure variation or fluid flow.

Figure 2F:
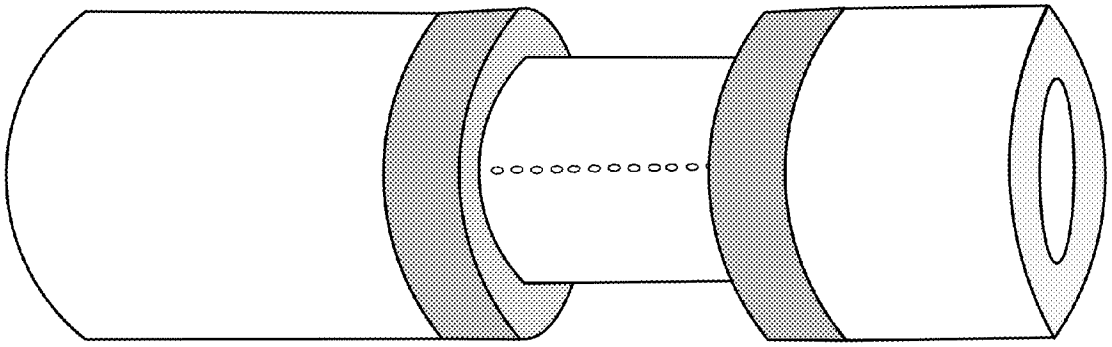
FIG. 2F is a three dimensional view of the multi nozzle pressure/flow control device.
Figure 2G:
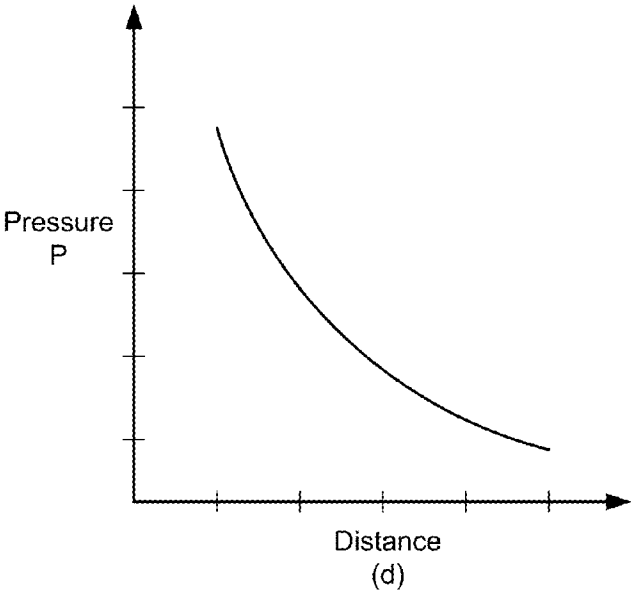
FIG. 2G indicates an example relation between the distance and the pressure.

FIG. 2B through FIG. 2E, illustrates example movement of the outer cylinder relatively away from the inner cylinder exposing corresponding more number of nozzles. Thus, when the outer cylinder is moved away from the inner cylinder the pressure drops. FIG. 2F is a three dimensional view of the multi nozzle pressure/flow control device. As may be seen, the nozzles are linearly arranged on one side of the inner cylinder. However, the nozzles may be arranged on with varying patterns to suit the requirement. Such patterns may be selected to vary the pressure with respect to distance moved. FIG. 2G indicates an example relation between the distance and the pressure. In the example, the pressure is shown decreasing exponentially with respect to the distance. However, various other functional relations such as linear, inverse square etc., may be obtained between the distance and pressure by changing the diameter of the nozzle, pattern of the nozzle etc. The manner in which the multi-nozzle device of the present invention may deployed in mechanical systems is further described below.

Figure 3A:
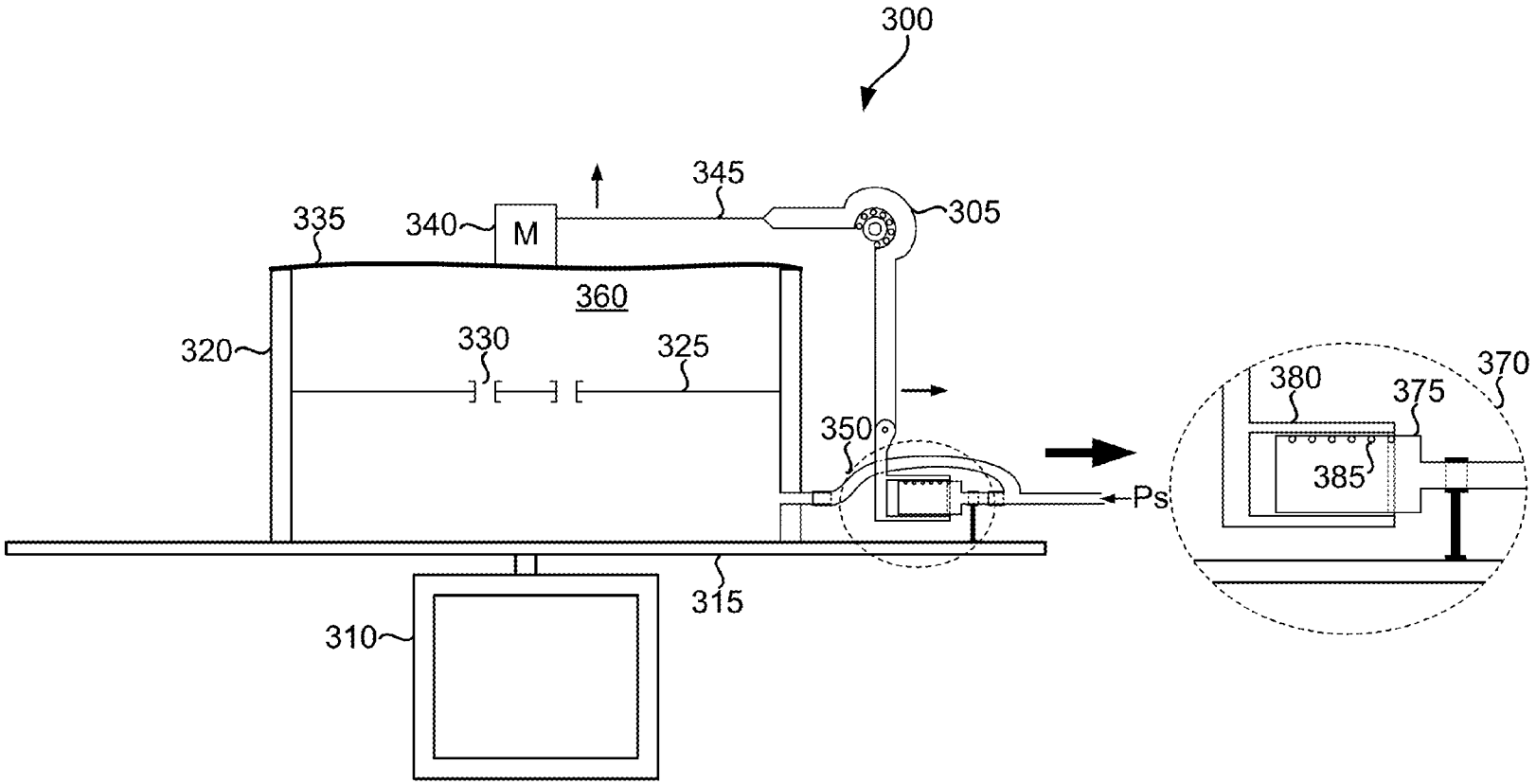
FIG. 3A is an example of a mechanical system operative to reduce the vibration transmission on a surface employing the multi nozzle device in one embodiment.
Figure 4:
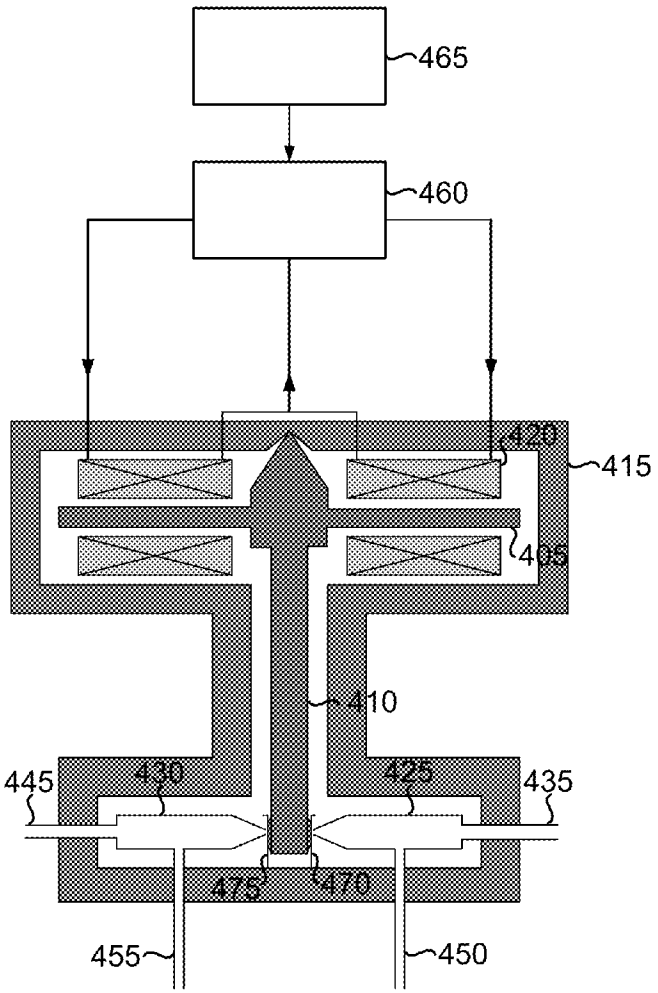
FIG. 4 is another example of application of flapper valve.

FIG. 3A is an example of a mechanical system operative to reduce the vibration transmission on a surface employing the multi nozzle device in one embodiment. The system is a pneumatic feedback vibration isolating multi nozzle control system 300. As shown in the figure, it has exciter 310 as primary vibrating source which sets up or generates the vibration on its output surface 315 at desired amplitude and at a desired frequency. The magnitude/amplitude and frequency of the exciter imparting vibration on its output surface may be varied. A main cylinder 320 is placed on the vibrating surface. As shown, in the centre of the cylinder the passage of air is restricted by a surface 325 which has orifices 330 for restricting the compressed air being transferred to the other end of the cylinder. At the top end of the cylinder a flexible diaphragm 335 covers the main cylinder 320, on the center of which a target payload 340 body of mass M is placed. A bell crank lever mechanism 305 is kept at a location which senses with the help of mechanical sensor 345 translates the vibration of the effected target device to the cylinder structure 380 blocking another cylinder which consists of multi nozzle device 375 in magnified representation of the control feedback shown dotted line section 370 from 350. The second inner cylinder allows the leakage of the compressed air which reduces the pressure in main cylinder 320. This mechanism counteracts the originally induced vibration in mutually opposite direction and hence nullifies the originally induced vibration by the primary vibrating source exciter 310. The compressed air (pneumatic) chamber 360 is the medium for the transfer of vibration from source exciter 310 to the target 340. The detailed explanation of the feed-back section is as follows. Due to the multi nozzle device, the vibration of smaller amplitude and larger amplitude may be controlled efficiently. Thereby enhancing the working range.

The small nozzle 115 of the conventional flapper valve connected to main cylinder 320 is replaced by inner hollow cylinder 375. This inner hollow cylinder 375 contains multi nozzles 385 for exposing the enclosed compressed air of the interior of main cylinder 320 to the outside atmosphere. Another sliding hollow cylindrical structure 380 encloses the inner hollow cylinder 375 which coincides with the axis of the inner cylinder in a manner to restrict the escape of compressed air from the inner cylinder. As can be seen, the surface length of the first inner hollow cylinder 375 with perforations and the second sliding hollow cylindrical structure 380 is made of sizes higher than the flapper. This may provide considerably higher control range (in general terms: leverage) in the amount of linear feedback to the control mechanism in this pneumatic vibration control system. FIG. 3B is an example list values illustrating the extended working range of the multi nozzle flapper valve.

Figure 5:
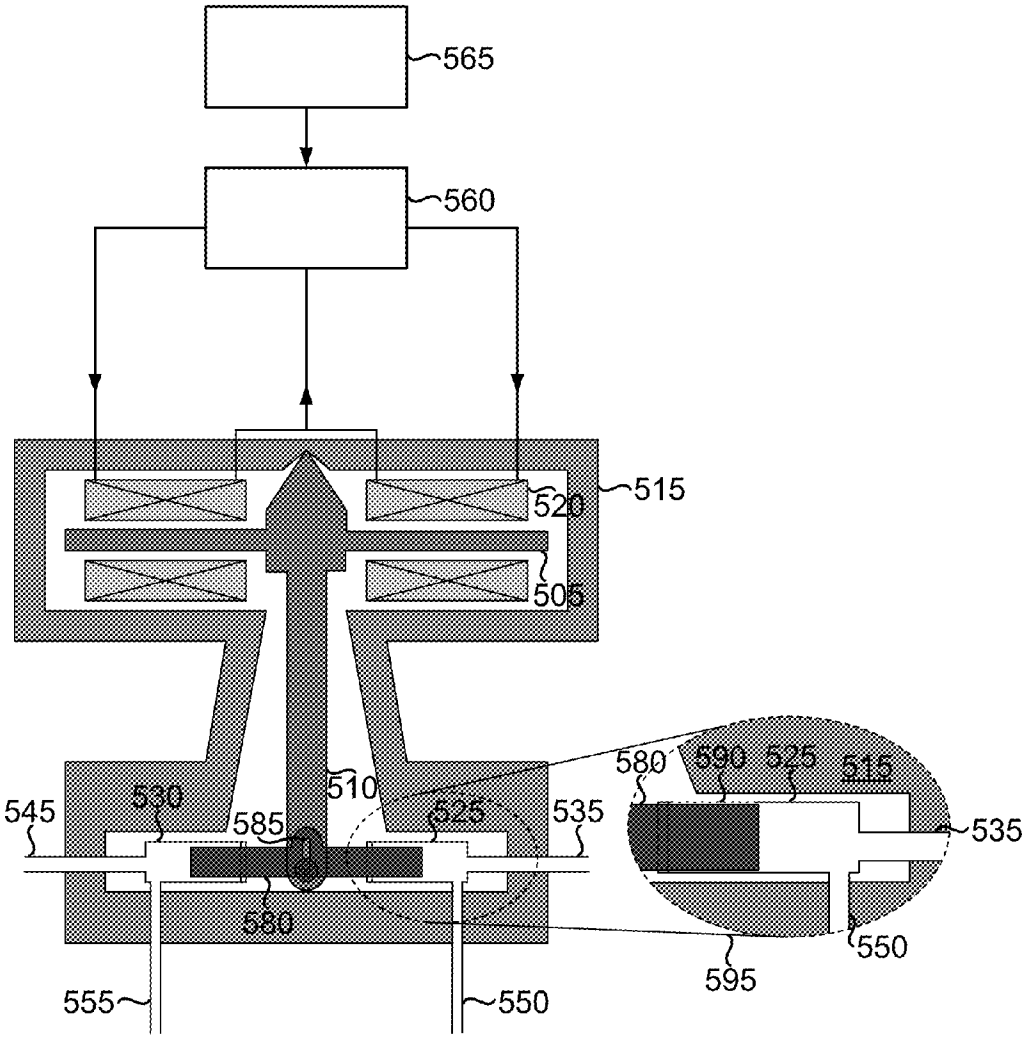
FIG. 5 is another example mechanical arrangement providing of differential pneumatic vibration control in one embodiment.

FIG. 5 is another example mechanical arrangement providing differential pneumatic vibration control in one embodiment. As shown there, it may have an electrically driven system to sense the source of vibration. It has sensor mechanism driver 560 with a pair of coils or solenoids 520 and Ferro-magnetic plate 505. This may result in movement of feedback control arm 510. In differential pneumatic vibration control arrangement shown here may have a pair of vibration feedback for left and right pneumatic systems. Here the right control system may be identical to the left control system. Wherein, the feedback control arm 510 may have a first cylindrical structure 580 connected in a position right angle to it. It may have a precision rocker system 585 to allow for forward linear motion while the feedback control arm 510 is turned fully into one of its maximum designed angular displacement. Here, the first cylindrical structure 580 performs action as similar to sliding hollow cylindrical structure 380 of FIG. 3A. It slides inside another finely perforated cylinder 525 and 530 of right and left side respectively. As can be seen here, the right control system may have right perforated cylinder 525, pneumatic input 535 and pneumatic output 550. The left control system may have left perforated cylinder 530, pneumatic input 545 and pneumatic output 555. The vibration sensor 565 may be connected to the mechanical vibration to electrical signal converter with its final stage as sensor mechanism driver 560. This mechanical vibration to electrical signal converter and sensor mechanism driver 560 may drive individual solenoids to control the left and right swing of feedback control arm 510 controlling left perforated cylinder 530 and right perforated cylinder 525 respectively. The enlarged view 595 of the right pneumatic control mechanism is shown. The multi nozzle device 590 made can be seen here on the first cylindrical structure 580.

Figure 6:
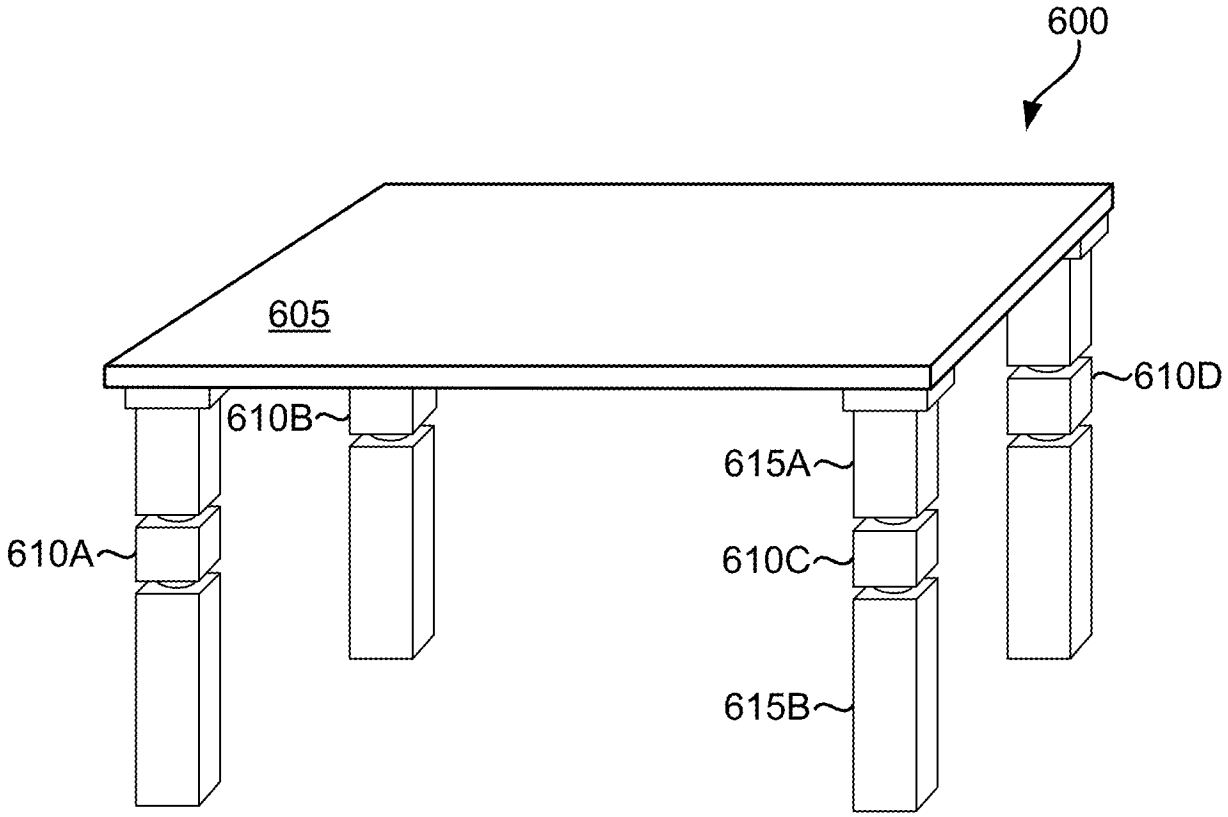
FIG. 6 is another example of vibration isolation arrangement in an alternative embodiment of the present invention.

FIG. 6 is another example of vibration isolation arrangement in an alternative embodiment of the present invention. As shown in the figure, a four legged table 600 has a table top 605. Each leg is split into two individual segments upper segment 615A and lower segment 615B. The vibration compensating mechanism 610A, 610B, 610C, 610D are inserted between each of the four legs of the table. These vibrations may sense the vibration from the ground and compensates it while transferring it to the upper segment of each leg. Each vibration compensating mechanism are implemented similar to the mechanism described with reference to FIG. 3A. The control of the vibration may also be carried out by external sensors and the associated fluid or electrical control lines individually connected to the individual vibration compensating sensors. As a result of this setup, when the ground below the table vibrates the resultant vibration may not be transferred to the table top 605 due to the combined actions of compensating segments.

Figure 7A:
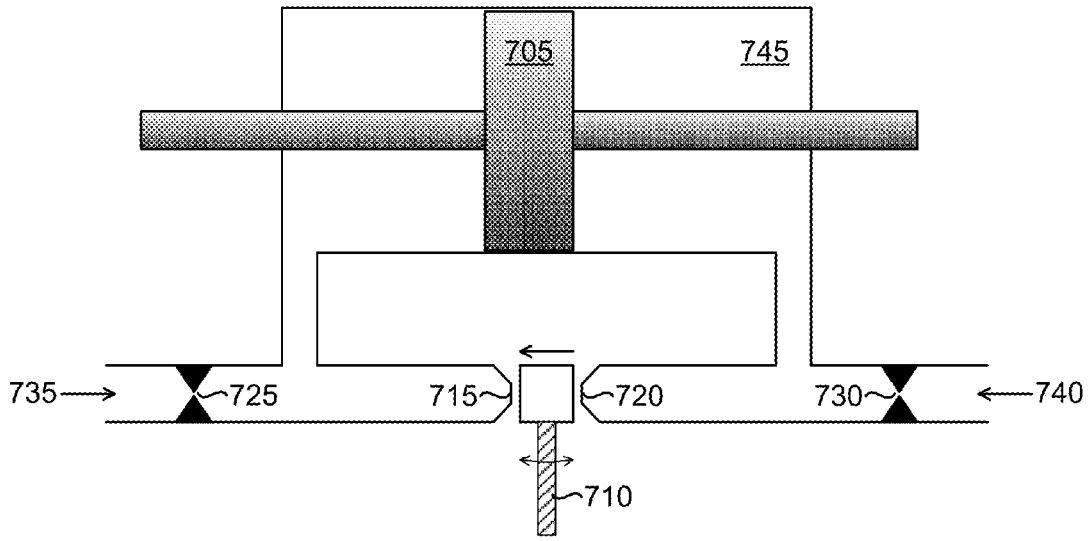
FIG. 7A is another example of differential pneumatic control arrangement using four way flapper nozzle.
Figure 7B:
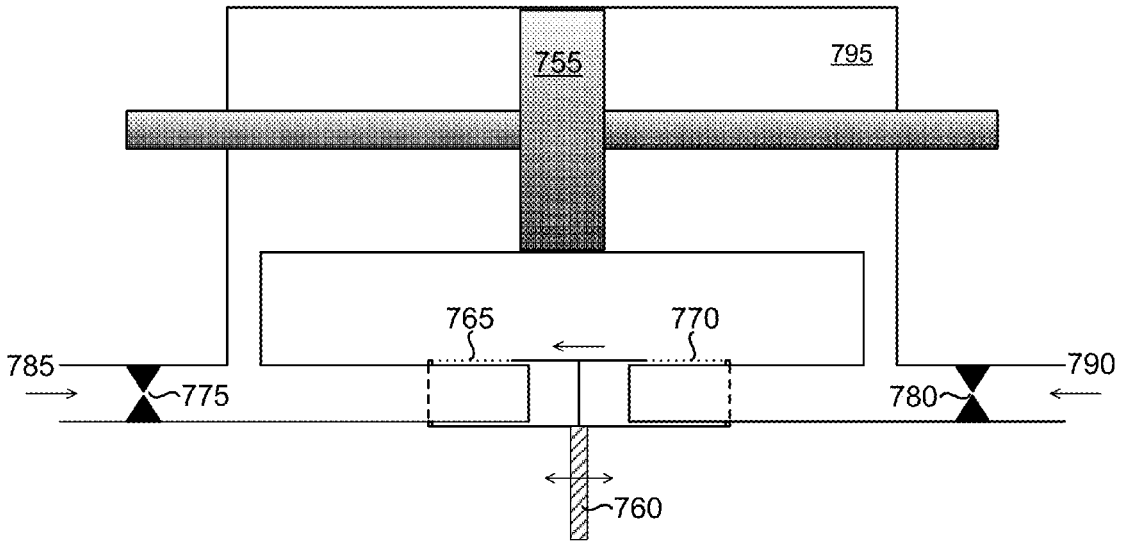
FIG. 7B is another mechanical arrangement for differential pneumatic control in one embodiment of the current invention.

FIG. 7B is another mechanical arrangement for differential pneumatic control in one embodiment of the current invention. Here the actuator 755 moves sideways in left or right motion in a chamber 795 with the help of the push pull control by the fluid passing through pressure at supply openings 785 and 790. 775 and 780 are constant orifices at both ends. 765 and 770 are two multi nozzles controlling the pressure inside the chamber 795. The Flapper 760 controls the orifice areas of both the nozzles. In this embodiment, we may observe that the control range for the actuator movement is increased effectively providing greater flexibility for the design involved.

In another embodiment, the multi nozzle pneumatic control may also effectively finds its use in pneumatic servo bearing actuator. Here the pressure of the bearing clearance normally is achieved with the help of a conventional flapper valve for the flow control of the pneumatic fluids. The restriction of smaller range may be reduced with the help of the multi nozzle flapper valve. This invention effectively targets the feasibility of using servo bearing controllers of larger structures in shape and size. In another embodiment, an opto-pneumatic on-off valve is an application in which the range enhancement feature of the multi nozzle flapper valve can be effectively used.

While various examples of the present disclosure have been described above, it should be understood that they have been presented by way of example, and not limitation. Thus, the breadth and scope of the present disclosure should not be limited by any of the above described examples, but should be defined in accordance with the following claims and their equivalents.

What is claimed is:

1. A pressure controlling device (370) to reduce transmission of a vibration from a first surface (315) to a second surface (335) coupled through a pressure chamber (360) comprising:

a bell crank lever mechanism (305) coupled to the second surface (335), providing linear displacement of a lever arm from its normal position by a first distance proportional to displacement of the second surface (335) with respect to the first surface (315) due to the vibration;

a hollow inner cylinder (375) having plurality of nozzles (385) arranged in a first pattern over its cylindrical surface;

an outer cylinder (380) fixed to the lever arm is mounted over the inner cylinder (375) such that inner cylindrical surface of the outer cylinder (380) slides over outer cylindrical surface of the inner cylinder (375) uncovering a first number of nozzles when the lever arm is displaced by the first distance and all the nozzles in the plurality of nozzles (385) are covered by the outer cylinder (380) when the lever arm is in the normal position; and a pressure source (Ps) providing a constant pressure is coupled to the pressure chamber (360) and to the inner cylinder (375) such that the constant pressure is supplied to the pressure chamber (360) when the lever arm is in the normal position and a first pressure is leaked out through the first number of nozzles when the lever arm is displaced by the first distance, in that, the first pattern provides a first relation between the first pressure and the first distance.

2. The device of claim 1, wherein the first relation between the first pressure and the first distance is a decaying exponential function.

3. The device of claim 1, wherein the pressure source (Ps) provides at least one of pneumatic pressure and a fluid pressure.

4. The device of claim 3, wherein each nozzle in the plurality of nozzles (385) has a diameter in relation to a maximum value of the constant pressure.

5. The device of claim 4, wherein each nozzle in the plurality of nozzles has a diameter proportional to the first relation and the first distance.

6. A method of reducing transmission of a vibration from a first surface (315) to a second surface (335) coupled through a pressure chamber (360) comprising:

converting a displacement of the second surface (335) with respect to first surface (315) due to the vibration in to a linear displacement by a first distance;

sliding an outer cylinder (380) over a hollow inner cylinder (375) having plurality of nozzles (385) arranged in a first pattern over its cylindrical surface such that a first number of nozzles are uncovered when linear displacement is equal to the first distance and all the nozzles in the plurality of nozzles (385) are covered by the outer cylinder (380) when the linear displacement is equal to zero; and coupling a constant pressure to the pressure chamber (360) and to the inner cylinder (375) such that the constant pressure is supplied to the pressure chamber (360) when the linear displacement is equal to zero and a first pressure is leaked out through the first number of nozzles when the linear displacement is equal to the first distance, in that, the first pattern provides a first relation between the first pressure and the first distance.

7. The method of claim 6, wherein the constant pressure is at least one of pneumatic pressure and a fluid pressure.

8. The method of claim 7, wherein each nozzle in the plurality of nozzles (385) has a diameter proportional to the first relation and the first distance.

* * * * *